US006585360B1

(12) United States Patent
Dietl

(10) Patent No.: US 6,585,360 B1
(45) Date of Patent: Jul. 1, 2003

(54) INK TANK CONSTRUCTION TO IMPROVE OPENING LEAKAGE AND INK SUPPLY/INK SENSING IN AN EASILY MOLDABLE DESIGN

(75) Inventor: Steven J. Dietl, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,614

(22) Filed: Nov. 28, 2000

(51) Int. Cl.[7] ..... B41J 2/175
(52) U.S. Cl. ..... 347/86
(58) Field of Search ..... 347/85, 86, 87, 347/92; 222/187; 239/43, 44

(56) References Cited

U.S. PATENT DOCUMENTS

| | | | | |
|---|---|---|---|---|
| 5,010,354 A | | 4/1991 | Cowger et al. | 347/87 |
| 5,903,294 A | * | 5/1999 | Abe et al. | 347/87 |
| 6,022,102 A | * | 2/2000 | Ikkatai et al. | 347/85 |
| 6,145,974 A | * | 11/2000 | Shinada et al. | 347/87 |
| 6,172,695 B1 | * | 1/2001 | Liu | 347/85 |
| 6,276,785 B1 | * | 8/2001 | Shinada et al. | 347/86 |
| 6,332,675 B1 | | 12/2001 | Koitabashi et al. | 347/86 |
| 6,345,888 B1 | * | 2/2002 | Matsumoto et al. | 347/86 |

FOREIGN PATENT DOCUMENTS

| | | | |
|---|---|---|---|
| JP | 06-040043 | | 2/1994 |
| JP | 08-034122 | * | 2/1996 |

* cited by examiner

*Primary Examiner*—Michael Nghiem
(74) *Attorney, Agent, or Firm*—Oliff & Berridge, PLC

(57) ABSTRACT

An ink tank, having an ink reservoir separated from an ink supply chamber which contains at least one foam element, is provided with one or more pipes in the partition which separates the ink reservoir from the ink supply chamber. The pipes transport ink from the ink reservoir to a portion of the ink supply chamber which does not contain the at least one foam element. This results in both minimizing leakage from the ink tank when the ink tank's protective seal is removed prior to inserting the ink tank into a print engine, and in more predictable ink supply pressure and accuracy from the ink tank to a print device.

20 Claims, 3 Drawing Sheets

INK TANK CONSTRUCTION TO IMPROVE OPENING LEAKAGE AND INK SUPPLY/INK SENSING IN AN EASILY MOLDABLE DESIGN

BACKGROUND OF THE INVENTION

1. Field of Invention

This invention is directed to construction of ink tanks used in print engines such as, for example, ink jet printers.

2. Description of Related Art

Conventional ink tank designs typically have seals which are removed when the ink tank is placed into a print engine. These ink tanks have been known to experience problems with leakage of ink when the seal, such as, for example, a foil seal, is removed prior to placing the ink tanks into the print engine. The leakage problem is often exacerbated when the ink tank seal is removed at the somewhat relatively lower atmospheric pressure which exists at high altitude locations. Some conventional tanks have a number of ink reservoir chambers. Any air trapped inside of these one or more ink reservoir chambers expands, when the seal is removed and the tank is directly exposed to relatively lower atmospheric pressure, to reach pressure equilibrium with respect to the relatively lower ambient atmospheric pressure. This expansion of air inside of the formerly sealed ink tank occurs rapidly and causes a rapid surge of ink from the one or more ink reservoir chambers where the air is located into the ink tank foam chamber, where an ink supply opening is located. This ink moves via a path or paths of least resistance, which often includes the ink tank supply opening, resulting in ink dripping out of this opening from the ink tank.

Moreover, some conventional ink tanks tend to have relatively poor ink supply consistency and accuracy. In a typical application, an optical sensing system is used to detect when the ink in the ink tank falls below a certain level. In such ink tanks, the amount of ink delivered between the ink reservoir chambers and the ink foam chamber, where an ink supply opening is located, is important in order to provide an accurate measure of how much usable ink remains in the ink tank. The amount of ink remaining in the ink tank when sensed low can be unpredictable due to the variable density and resistance to fluid and air flow that is inherent with foam. In addition, if the resistance of the foam to air flow to the rear chamber is extreme, the ink tank may "deprime" resulting in a severe defect on the customer's print.

SUMMARY OF THE INVENTION

This invention provides an ink tank construction which reduces the leakage of ink from an ink tank when the protective seal is removed.

This invention separately provides an ink tank construction that is able to reduce the leakage of ink from an ink tank when the protective seal is removed at relatively high altitudes.

This invention separately provides an ink tank construction which provides a low impedance path to conduct the ink from an ink reservoir portion of the ink tank into a safe area of the tank.

This invention separately provides an ink tank construction that uses a low impedance path to determine and regulate the ink supply pressure of an ink tank to In various exemplary embodiments of the ink tank construction according to this invention, this low impedance path comprises one or more pipes extending between an ink reservoir chamber and an ink supply chamber. In other various exemplary embodiments of the ink tank construction according to this invention, this low impedance path decouples the ink supply of ink to the ink supply chamber from the ink supply of ink from the ink supply chamber. This renders the ink supply consistency and accuracy less dependent on the known variability in density and ink flow resistance of foam.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
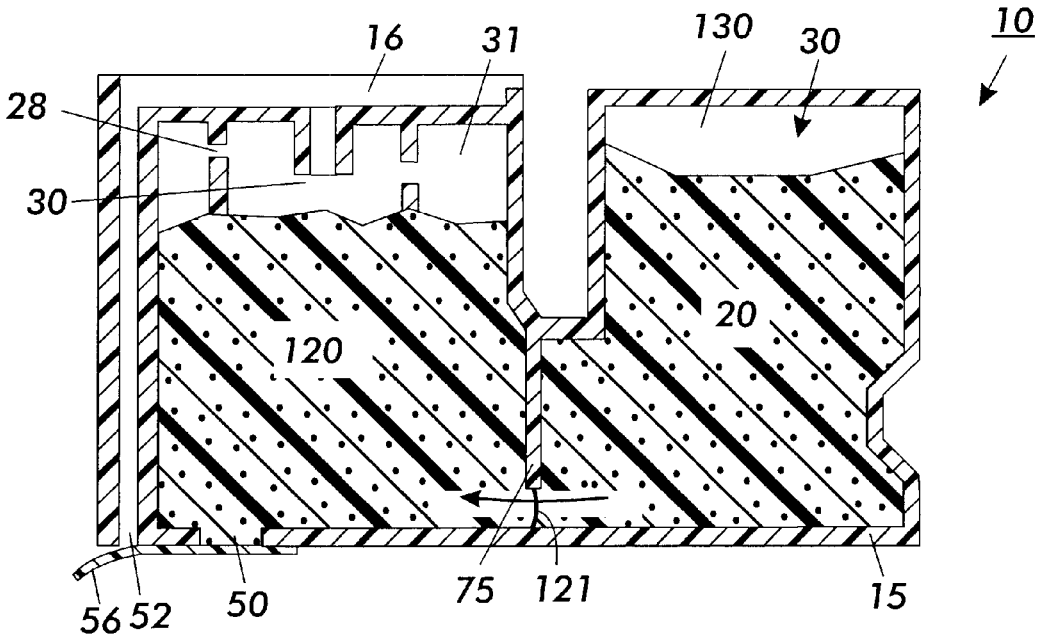
FIG. 1 is a cross-sectional view of an ink tank with a removable seal covering the ink supply opening and vent tube.

FIG. 1 is a cross-sectional view of a conventional ink tank 10. The ink tank 10 has an ink supply chamber 110 and an ink reservoir chamber 130. The ink reservoir chamber 130 is partially filled with ink 20. The remaining space 30 above the ink 20 is filled with air. The ink supply chamber 110 has an ink supply opening 50. A large portion of the ink supply chamber 110 is taken up by a foam element 120, which forms a lower boundary between the ink supply chamber 110 and the ink reservoir 130. The ink reservoir 130 is separated from the ink supply chamber 110 by a partition wall 75, which does not completely separate the two chambers, but permits the ink 20 to flow between the ink supply chamber 110 and the ink reservoir chamber 130, through an opening 121 formed between the partition wall 175 and the bottom of ink tank 10. In one exemplary embodiment, the opening 121 was about 3mm high and about 9mm wide.

The ink tank 10 also has an ink tank vent 52 which opens into a bottom wall 15 of the ink tank 10. FIG. 1 shows a removable seal 56, which may be made of any ink impermeable material, such as, for example, a metal foil. The removable seal 56 covers both the ink supply opening 50 and the ink tank vent, 52.

Figure 2:
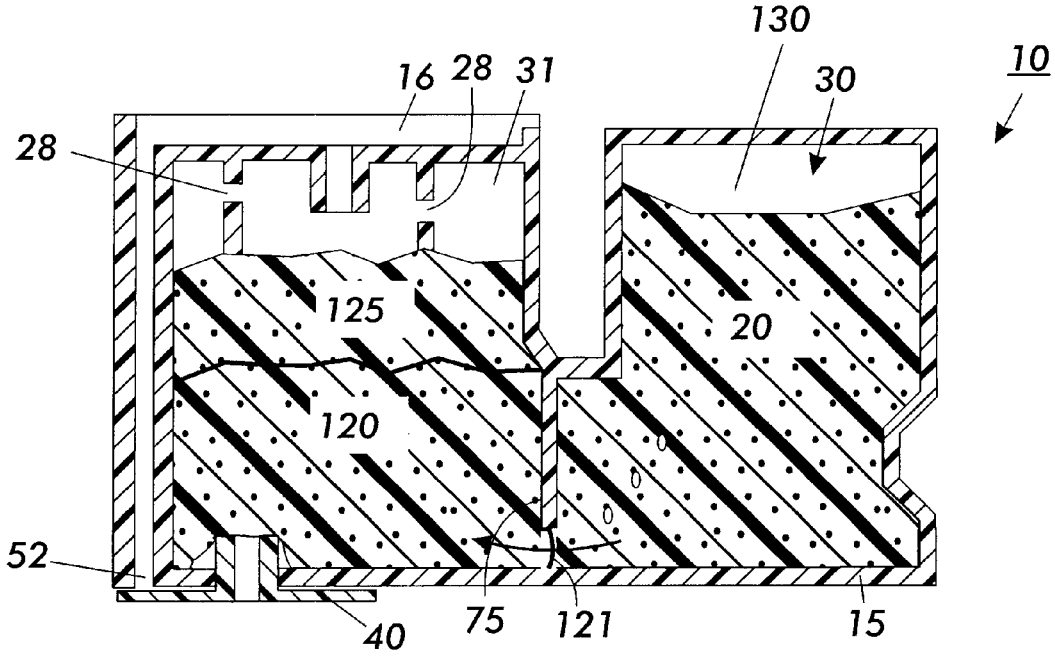
FIG. 2 is a cross-sectional view of the ink tank with its seal removed and an ink manifold pipe inserted in the ink supply opening.

FIG. 2 shows the ink tank 10 after the removable seal 56 has been removed and the ink tank 10 has been positioned on an ink supply pipe 40. The ink supply pipe 40 has been inserted into the ink supply opening 50 and has displaced part of the foam 120 adjacent to the ink supply pipe 40. The ink 20 in the ink reservoir chamber 130 is shown as having bubbles. In order for bubbles to form in the ink reservoir 130, a portion 125 of the foam 120 has to become desaturated. Desaturating a portion 125 of the foam 120 in ink tank 10, thus providing a free passage for the air bubbles to reach the ink reservoir chamber, has been unpredictable, prior to this invention, due to variations in the properties of the foam, some of which are due to the manufacture of the foam 120. An arrow indicates the direction of flow of the ink 20 from ink reservoir 130 into the foam 120 across a foam boundary 121.

Figure 3:
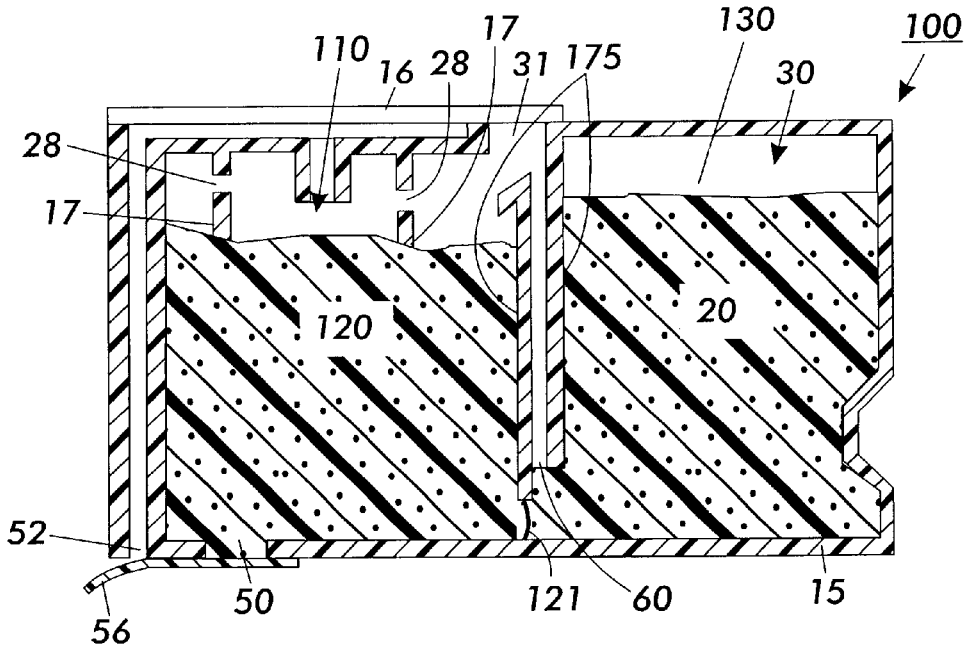
FIG. 3 is a cross-sectional view of one exemplary embodiment of an ink tank according to this invention having one or more pipes between an ink reservoir and a foam containing chamber and a removable seal covering the ink supply opening and vent tube.

FIG. 3 shows one exemplary embodiment of an ink tank 100 according to this invention, with its removable seal 56 intact, i.e., prior to removal of the seal 56 and installation of the ink tank 100 on the ink tank supply pipe 40. The ink tank 100 contains one or more pipes 60 formed in the partition wall 175 which separates ink reservoir chamber 130 and the ink supply chamber 110. The pipes 60 are molded into the partition wall 175 between the ink supply chamber 110 in which the foam element 120 is located and the ink reservoir chamber 130. The top of each pipe 60 is located above the top of the foam 120, which is generally kept below the spacer elements 17 in FIG. 3 in the ink supply chamber 110. This leaves an air space 31 into which the ink, which can be forced up the pipes 60 in response to a pressure difference between the ink reservoir and ink supply chambers, can enter. In various exemplary embodiments, the air space 31 and the long pipes 60 are formed during the molding process and the opening needed to form the pipes is sealed off with a seal 16 located on the top wall of the ink tank 100. The pipes 60 can be sized as small as capillaries or larger, and can have capillary sized openings at the bottom of the one or more pipes but be larger in diameter or cross-section above the opening at the bottom end of the one or more pipes 60. Spacer elements 17 keep the foam element 120 from filling the entire ink supply chamber 110, and provide an air chambers 31 above the foam element 120. The air chambers 31 are interconnected by openings 28 in spacer elements 17 so that all of the air above the foam element 120 is at the same pressure.

Figure 4:
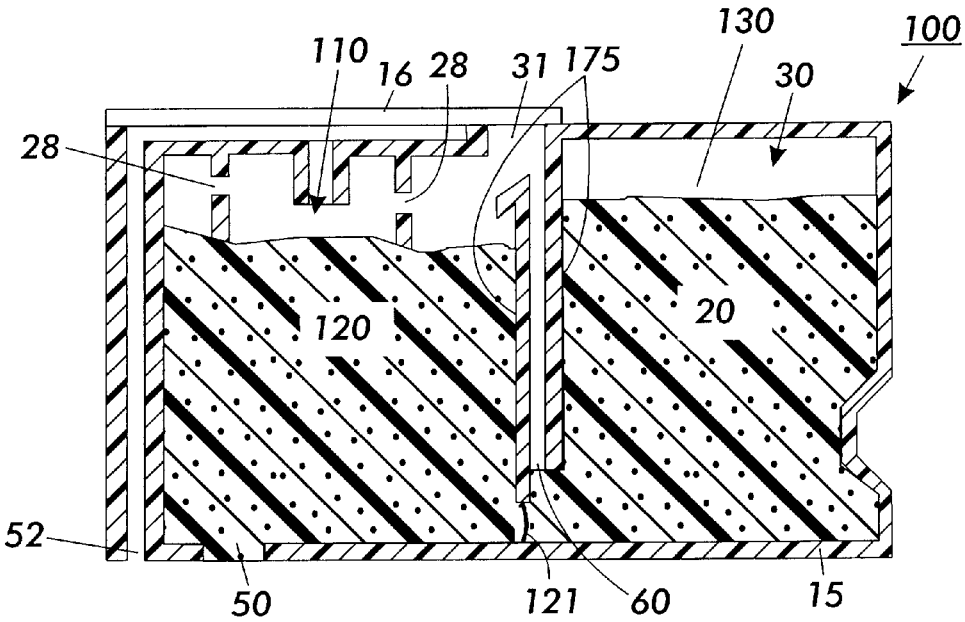
FIG. 4 is a cross-sectional view of the ink tank of FIG. 3 with the removable seal removed.

FIG. 4 shows the ink tank 100 after the removable seal 56 has been removed, and prior to insertion of the ink tank supply pipe 40 into the ink tank supply opening 50. When the ink tank 100 is opened up by removing the removable seal 56, the air in the top portion 30 of ink reservoir chamber 130 forces the ink 20 up into one or more of the pipes 60. The ink 20 that is forced up into the pipes 60 overflows onto the top of foam element 120, where this ink 20 can be absorbed.

Figure 5:
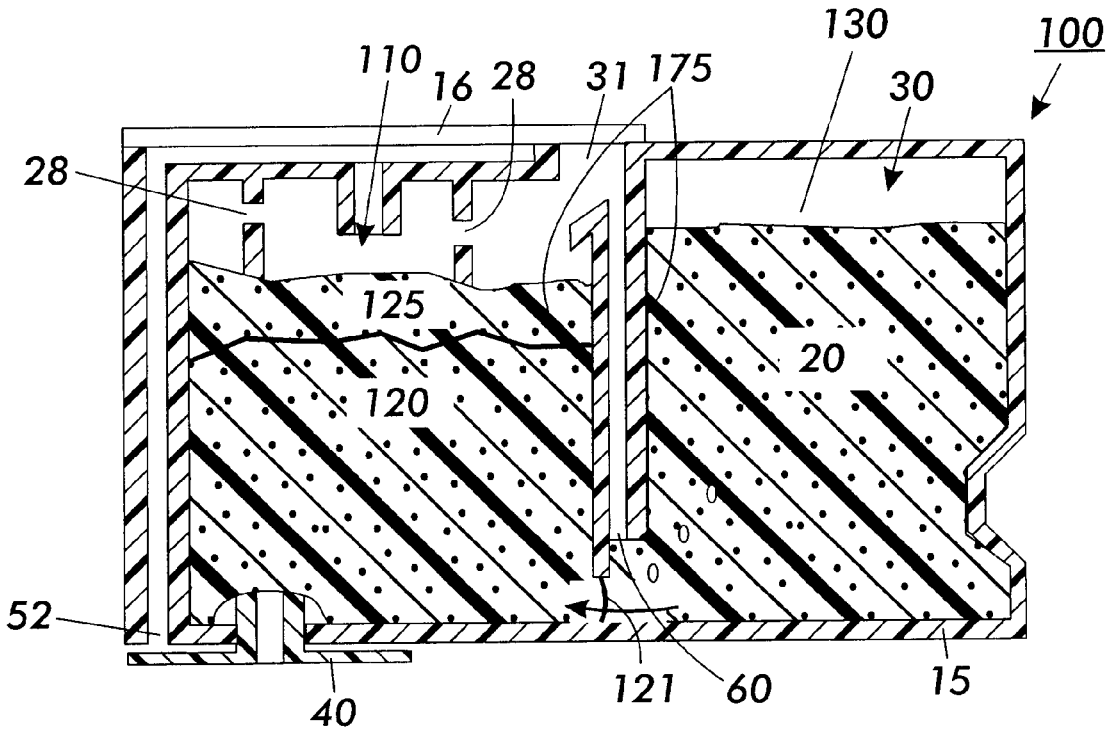
FIG. 5 is a cross-sectional view of the ink tank of FIG. 3 with an ink manifold pipe inserted in the ink supply opening.

FIG. 5 shows the ink tank 100 after the ink tank supply pipe 40 has been inserted into the ink tank 100. During supply of the ink 20 from the ink supply chamber 110 via the ink supply pipe 40, the air bubbles out of the bottom of pipes 60 into the ink reservoir chamber 130. The pressure needed to pull the ink 20 through the pipes 60 and to generate an air bubble in the rear, reservoir, chamber, determines the operating or negative pressure of the ink tank 100. The ink tank operating pressure can be adjusted or tuned by molding a fine hole at the bottom exit of the long pipe 60. In various exemplary embodiments, the fine hole has a diameter of, for example, between 0.5 mm and 1 mm.

In some exemplary embodiments, the pipe 60 may be larger in diameter throughout most of its length than the opening 61 in the bottom of the pipe 60. This tends to facilitate flow of air bubbles into the space 31 above the pipe 60. The amount of the ink 20 drawn out of the ink tank 100 before the first bubble occurs between the foam 120 and ink reservoir chamber 130 is relatively more predictable in the ink tank 100 with one or more of the pipes 60, because the impedance of the foam to air is not a significant factor.

This invention provides an ink tank that is configured to substantially reduce the possibility that ink will leak from the ink tank when the protective seal is removed prior to installing the ink tank and after the ink tank is installed on an ink tank supply pipe.

In various exemplary embodiments, the pipe is formed in or on the partition wall, where the partition wall defines at least a portion of the surface of the pipe. In other exemplary embodiments, a separate pipe can be placed in the ink tank to connect the ink tank reservoir and the ink tank supply chamber 110. In this case, the pipe can be attached to the partition wall, but does not need to be so attached.

In various exemplary embodiments, as outlined above, the ink is delivered to the ink supply chamber 110 that does not contain the at least one foam element 120, and thus does not contain the ink 20. In various other exemplary embodiments, the ink is delivered to a portion of the at least one foam element 120 that, during normal operation, is not saturated with ink, i.e., a portion of the at least one foam element 120 that has subportions that do not contain the ink 20. In this case, the air space 31 can be omitted, such that the at least one foam element 120 at least substantially fills the ink supply chamber 110.

One other advantage of this invention is the reduction in deprime situations, i.e., situations in which air, instead of ink, is drawn through the foam element 120 to the ink supply orifice 50. In a deprime situation, the ink supply tube 40 draws air along with, or instead of, the ink 20 into the ink supply tube 40 to the print head (not shown). This happens when air is drawn into the bottom of the foam element 120 and displaces the 20 ink in the bottom of the foam element 120. In exemplary embodiments of this invention, however, air is displaced from the bottom of the foam element 120 into the ink reservoir chamber 130 and drawn up into the air space 31 on top of the foam element 120 by the one or more pipes 60. In this manner, the ink is drawn from the ink reservoir 130 into the foam element 120. As a result, deprime situations occur significantly less often.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An ink tank, comprising:

an ink tank reservoir;

an ink supply chamber having an ink supply opening usable to discharge ink from the ink tank through the ink supply opening;

at least one foam element located in a portion of the ink supply chamber;

an air ventilation chamber located above the foam chamber in a portion of the ink supply chamber;

a partition located between the ink tank reservoir and ink supply chamber such that the ink supply chamber is located in side-by-side relationship with the ink tank reservoir; and at least one pipe connecting the ink tank reservoir and the air ventilation chamber.

2. The ink tank of claim 1, wherein a portion of the at least one foam element is not saturated with ink.

3. The ink tank of claim 2, wherein the non-saturated portion of the at least one foam element is located in the upper portion of at least one of the at least one foam element when the ink tank is in an operating position.

4. The ink tank of claim 1, wherein each of the at least one pipe contains an exit opening at the bottom of the pipe when the ink tank is in an operating position.

5. The ink tank of claim 1, wherein the at least one pipe is attached to the partition.

6. The ink tank of claim 1, wherein the connecting pipe has a capillary sized opening.

7. The ink tank of claim 1, wherein the connecting pipe is a capillary tube.

8. An ink tank, comprising:

an ink tank reservoir;

an ink supply chamber integral with the ink tank reservoir;

at least one foam element located in a portion of the ink supply chamber;

an air ventilation chamber located above the foam element in a portion of the ink supply chamber in which at least one foam element is not located comprising the air ventilation chamber;

a partition located between the ink tank reservoir and ink supply chamber; and at least one pipe connecting the ink tank reservoir and the air ventilation chamber;

wherein the pipe is positioned to transport ink from the reservoir to a portion of the ink supply chamber in which at least one foam element is not located.

9. An ink tank, comprising:

an ink tank reservoir;

an ink supply chamber integral with the ink tank reservoir;

at least one foam element located in a portion of the ink supply chamber;

an air ventilation chamber located above the foam element in a portion of the ink supply chamber;

a partition located between the ink tank reservoir and ink supply chamber; and at least one pipe connecting the ink tank reservoir and the air ventilation chamber wherein the at least one pipe is located in the partition.

10. The ink tank of claim 9, wherein the at least one pipe located in the partition is formed in the partition.

11. The ink tank of claim 9, wherein the at least one pipe located in the partition has at least one portion of a surface of the pipe defined by the partition.

12. A method of transferring ink within an ink tank that includes an ink reservoir and an ink supply chamber in side-by-side relationship, the ink supply chamber having an ink supply opening usable to discharge ink from the ink tank through the ink supply opening, with at least one foam element in a portion of the ink supply chamber and an airspace located above the at least one foam element in the ink supply chamber, the reservoir and supply chamber separated by a partition, wherein there is no partition between the foam element and the airspace, the method comprising:

transferring ink from the ink reservoir to the ink supply chamber through at least one low-impedance path to the airspace.

13. The method of claim 12, wherein transferring the ink from the ink reservoir to the ink supply chamber through at least one low-impedance path comprises transferring the ink to the ink supply chamber through at least one pipe connecting the ink tank reservoir and the ink supply chamber.

14. A method of transferring ink within an ink tank that includes an ink reservoir integral with an ink supply chamber with at least one foam element in a portion of the ink supply chamber, the reservoir and supply chamber separated by a partition, the method comprising:

transferring ink from the ink reservoir to the ink supply chamber through at least one low-impedance path to a portion of the ink supply chamber that does not contain ink;

wherein a portion of the ink supply chamber does not contain the at least one foam element and comprises an air space above the foam element; and transferring the ink from the ink reservoir to the ink supply chamber through at least one low-impedance path to a portion of the ink supply chamber that does not contain ink comprises transferring the ink to the ink supply chamber to the portion of the ink tank that does not contain the at least one foam element.

15. A method of transferring ink within an ink tank that includes an ink reservoir and an ink supply chamber in side-by-side relationship, with at least one foam element in a portion of the ink supply chamber and an airspace located above the foam, the reservoir and supply chamber separated by a partition, the method comprising:

transferring ink from the ink reservoir to the ink supply chamber through at least one low-impedance path to a portion of the ink supply chamber that does not contain ink and comprises the airspace; wherein:

a portion of the at least one foam element is not saturated with ink; and transferring the ink from the ink reservoir to the ink supply chamber through at least one low-impedance path to a portion of the ink supply chamber that does not contain ink comprises transferring the ink to the ink supply chamber to a portion of the ink supply chamber containing the airspace and the portion of the at least one foam element that is not saturated with ink.

16. A method of transferring ink within an ink tank that includes an ink reservoir and an ink supply chamber having a foam element in side-by-side relationship, the ink supply chamber having an ink supply opening usable to discharge ink from the ink tank through the ink supply opening, the reservoir and supply chamber in side-by-side relationship and an airspace located in the supply chamber above the foam element, the reservoir and supply chamber separated by a partition, wherein there is no partition between the foam element and the airspace, the method comprising:

transferring ink from the ink reservoir to the airspace within the ink supply chamber through at least one pipe connecting the ink tank reservoir and the ink supply chamber.

17. A method of transferring ink within an ink tank that includes an ink reservoir and an ink supply chamber, the reservoir and supply chamber in side-by-side relationship and separated by a partition, the method comprising:

transferring ink from the ink reservoir to the ink supply chamber through at least one pipe connecting the ink reservoir and the ink supply chamber, wherein:

the ink supply chamber contains at least one foam element that occupies less than all of the ink supply chamber and an airspace located above the foam element; and transferring the ink from the ink reservoir to the ink supply chamber through at least one pipe connecting the ink reservoir and the ink supply chamber comprises transferring the ink to the airspace within the ink supply chamber.

18. A method of transferring ink within an ink tank that includes an ink reservoir and an ink supply chamber in side-by-side relationship, the ink supply chamber having an ink supply opening usable to discharge ink from the ink tank through the ink supply opening, with at least one foam element in a portion of the ink supply chamber and an airspace located in the ink supply chamber above the foam element, the reservoir and supply chamber separated by a partition having an opening, wherein there is no partition between the foam element and the airspace, the method comprising:

transferring ink from the ink reservoir to the ink supply chamber through at least one pipe connecting the ink tank reservoir and the ink supply chamber, wherein:

the ink supply chamber contains at least one foam element; and transferring the ink from the ink reservoir to the ink supply chamber through at least one pipe connecting the ink tank reservoir and the ink supply chamber comprises transferring the ink to the ink supply chamber to a portion of the ink supply chamber containing the airspace and a portion of the at least one foam element that is not saturated with ink.

19. An ink tank, comprising:

an ink tank reservoir;

an ink supply chamber integral with the ink tank reservoir;

at least one foam element located in a portion of the ink supply chamber;

an air ventilation chamber located above the roam element in a portion of the ink supply chamber;

a partition located between the ink tank reservoir and ink supply chamber; and at least one pipe connecting the ink tank reservoir and the air ventilation chamber;

wherein the air ventilation chamber is located entirely above the foam element in a portion of the ink supply chamber.

20. An ink tank, comprising:

an ink tank reservoir;

an ink supply chamber integral with the ink tank reservoir and having an ink supply opening usable to discharge ink from the ink tank through the ink supply opening;

at least one foam element located in a portion of the ink supply chamber;

an air ventilation chamber located above the foam element in a portion of the ink supply chamber;

a partition located between the ink tank reservoir and ink supply chamber; and at least one pipe, connecting the ink tank reservoir and the air ventilation chamber.

* * * * *